US005123359A

United States Patent [19]

DelBalso

[11] Patent Number: 5,123,359

[45] Date of Patent: Jun. 23, 1992

[54] HEAVY DUTY PALLET AND METHOD OF MAKING SAME

[75] Inventor: Michael W. DelBalso, Clay, N.Y.

[73] Assignee: T.H.E.M. of New York, Inc., Syracuse, N.Y.

[21] Appl. No.: 620,905

[22] Filed: Dec. 3, 1990

[51] Int. Cl.[5] ..... B65D 19/26

[52] U.S. Cl. ..... 108/51.1; 108/55.1; 108/901

[58] Field of Search ..... 108/51.1, 901, 902, 108/55.1

[56] References Cited

U.S. PATENT DOCUMENTS

| | | | |
|---|---|---|---|
| 3,719,157 | 3/1973 | Arcocha et al. | 108/901 X |
| 3,832,955 | 9/1974 | Pottinger et al. | 108/901 X |
| 3,880,092 | 4/1975 | Seeber et al. | 108/901 X |
| 4,399,975 | 8/1983 | Trimarco et al. | 108/901 X |
| 4,879,956 | 11/1989 | Shuert | 108/901 X |
| 4,966,083 | 10/1990 | Cerugeira | 108/51.1 |

FOREIGN PATENT DOCUMENTS

| | | | |
|---|---|---|---|
| 2224398 | 11/1972 | Fed. Rep. of Germany | 108/51.1 |
| 2229622 | 5/1973 | France | 108/51.1 |

*Primary Examiner*—Peter A. Aschenbrenner
*Attorney, Agent, or Firm*—Wall and Roehrig

[57] ABSTRACT

A durable heavy duty pallet having a flat load deck is made by placing a pre-cut plastic sheet under the load-bearing surface of an invented frame or skeleton. A second plastic sheet is thermoformed over the lower surface of the skeleton, brought down into tight conformity with the contours thereof and into contact with the first plastic sheet. The perimeters of the plastic sheets are bonded together to form an integral plastic skin over the skeleton. The pallet thus formed is capable of bearing a static load up to 40,000 lbs.

18 Claims, 2 Drawing Sheets

HEAVY DUTY PALLET AND METHOD OF MAKING SAME

BACKGROUND OF THE INVENTION

The present invention relates to cargo handling and storage apparatus, and more particularly, to pallets for handling and storing heavy loads.

Pallets are in widespread industrial use for storing and shipping goods, the goods frequently confined within containers or in bundles as the nature of the goods permits. It is the usual practice to load selected quantities of goods on a pallet which typically is capable of receiving the fingers of a forklift to move the goods from one location to another or to deposit them on the bed of a vehicle.

DETAILED DESCRIPTION OF THE PRIOR ART

For many years pallets for handling heavy loads have been constructed of spaced wooden or special slats overlying and secured to a plurality of wooden rails by nails or the like. In many cases shearing forces necessitated a second underlying layer of slats or bottom boards to prevent angular twisting of the rails. Such wooden pallets have the further potential of damaging the undersurface of the load or catching on load supporting surfaces as nail heads work loose or otherwise protrude. The usable life of wooden pallets is generally short as they are damaged during handling. Such damage can result in loss of strength or actual structural failure with resultant shifting of or damage to the load. Should this occur while the goods are in transit, a dangerous situation could arise in the transportation vehicle. Furthermore, wooden pallets are not particularly weather resistant, and are subject to rotting when exposed to moisture.

Molded weather resistant plastic pallets, constructed of formed plastic, are relatively new, and depend upon a network of formed ribs for their strength. Molded pallets are expensive, requiring high cost tooling for their manufacture, and the load carrying capability is generally limited. Under heavy loads the plastic can deform and fracture followed by rapid loss of strength, partial or total collapse of the pallet. Here again a collapsed pallet poses risk of damage to the load, transportation vehicle and anyone nearby.

It is taught in U.S. Pat. No. 4,509,432 to Win to use plastic film to provide taut load supporting surfaces over pallet structural or load bearing members. One or more sheets of plastic film are wrapped about the longitudinal and cross members of the pallet. Such pallets are capable of supporting heavy loads. However, the plastic film can be pierced by load projections such as legs or uneven weight distribution over the surface of the pallet.

A use of laminates in static support structures is taught in U.S. Pat. No. 4,399,975 to Trimarco. Weather resistant laminates formed of materials such as a combination of polyester and chopped fiberglass are applied to a wooden skeleton. This increases the strength of the structure as well as extends its life. However this technique does not provide for flat load decks which are desirable with certain kinds of loads.

U.S. Pat. No. 4,145,975 to Colbert describes a pallet in which a thin sheet of plastic bridges two slats to form a central flat load bearing surface. The load bearing surface is limited to application where two slats will suffice, and is not generally applicable to large pallets having specialized shapes.

SUMMARY OF THE INVENTION

A pallet is constructed by first making a wooden skeleton using conventional techniques. The skeleton is placed inverted upon a plastic top sheet which has been pre-cut to size and shape or preferably dual sheet molded. A pre-heated bottom plastic sheet is placed over the skeleton and, then employing a combination of heat and suction as is well known in the plastic thermoforming art, pulled down to tightly conform to the skeleton and the top sheet. The top sheet and bottom sheet are bonded at their edges to form a continuous seam and thereby a continuous weather resistant plastic skin. The plastic skin so formed distributes shearing forces and vertical load throughout the pallet, enhancing its strength. No bottom boards are needed. The top sheet provides a flat load bearing deck which can be made skid resistant by grooving or roughening the surface. With this technique pallets of varying sizes and specialized shapes can be economically fabricated without retooling the thermoforming equipment, as the plastic is thermoformed over the skeleton itself. There is no need to create a separate mold for each pallet variant, as is normally required in plastic thermoforming. It is also possible to reutilize skeletal components in replacement pallets by simply removing the plastic sheets and detaching the members desired to be reused.

It is therefore an object of the present invention to provide an improved light weight, durable, weather resistant pallet capable of bearing extremely heavy loads and a method of making same.

Another object of the invention is to provide a durable pallet capable of resisting high shearing forces.

Still another object of the invention is to provide a pallet whose parts can be reused.

Still another object of the invention is to provide a pallet having a flat, unitized load-bearing deck which will not damage the undersurface of the load.

Yet another object of the invention is to provide a method of economically fabricating multiple pallet variants by plastic thermoforming technique without having to retool the forming apparatus.

BRIEF DESCRIPTION OF THE DRAWING

For a better understanding of these and other objects of the present invention reference is made to the following detailed description of the invention that is to be read in conjunction with the accompanying Drawings, wherein.

DETAILED DESCRIPTION OF THE INVENTION

Figure 1:
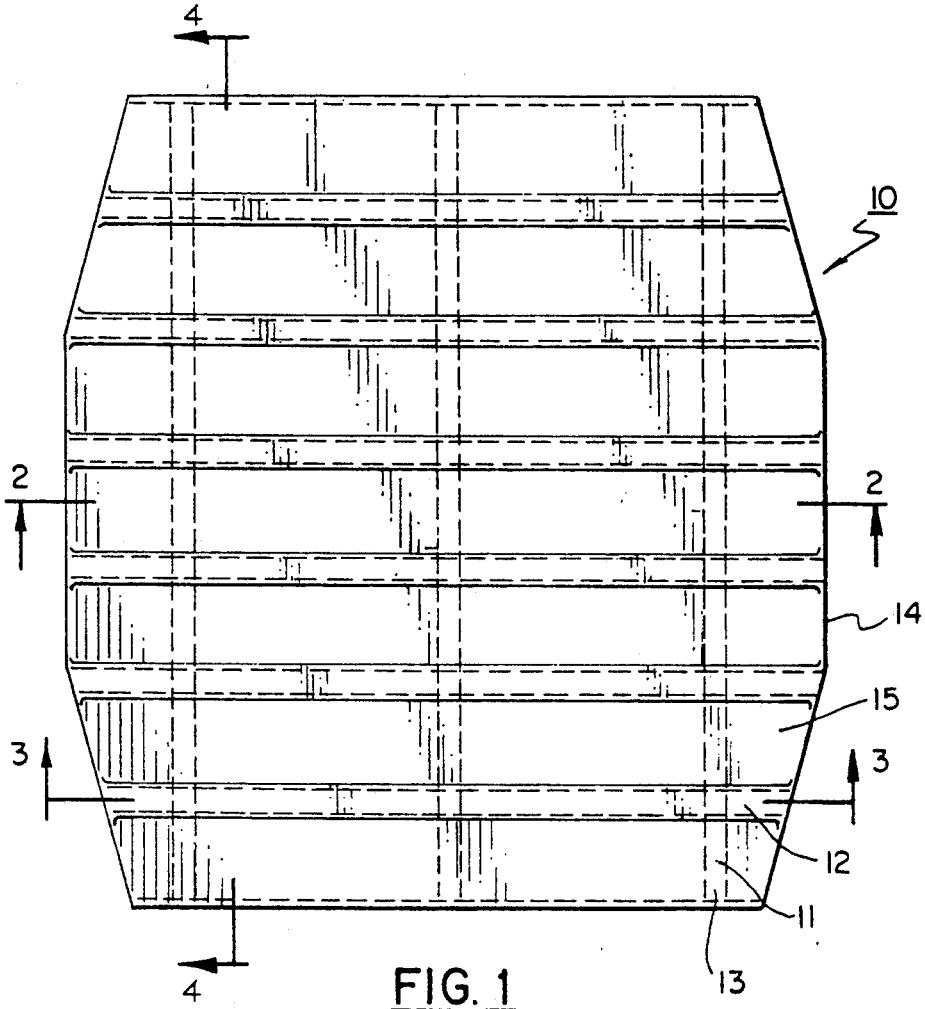
FIG. 1 is a plan view of an embodiment of the invention.
Figure 5:
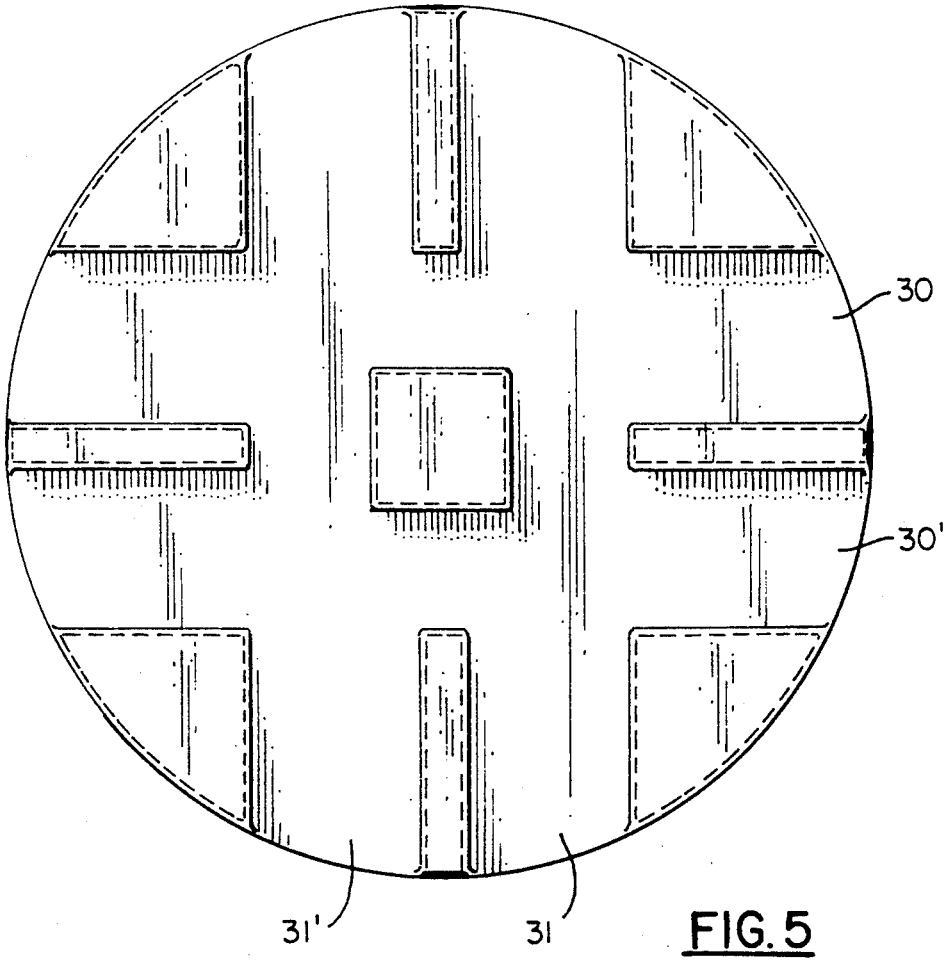
FIG. 5 is a bottom view through an alternate embodiment of the invention.

Referring now to FIG. 1 of the drawings a skeleton shown generally at 10 is basically formed by a plurality of longitudinal members 11 usually in parallel spaced relationship and a plurality of transverse members 12 also usually in parallel spaced relationship overlying the longitudinal members and intersecting them substantially at right angles. These members are rigidly joined at their intersections by any suitable means such as coated nails, as is well known in the pallet making art. It will be appreciated that wide variations in the dimension and spatial relationships among the longitudinal and transverse members are possible to accommodate special loads without departing from the spirit of the invention. Conventionally the skeleton members are of wood, but other materials such as aluminium are suitable. For supporting heavy loads up to 40,000 lbs static load longitudinal members comprising 4"×4" boards have been satisfactory. The transverse members can be of any convenient width and should be at least 1" thick. With these members, pallets varying in size up to 96 inches × 69 inches are capable of bearing loads up to 40,000 lbs. Gaps or notches can be provided in the longitudinal members to allow 4 way entry by the fingers of a fork lift. For example in FIG. 5 which depicts an alternate embodiment of the invention, it will be apparent that gaps 30—30' and 31—31' will permit such entry by a forklift from any of 4 directions.

Figure 2:
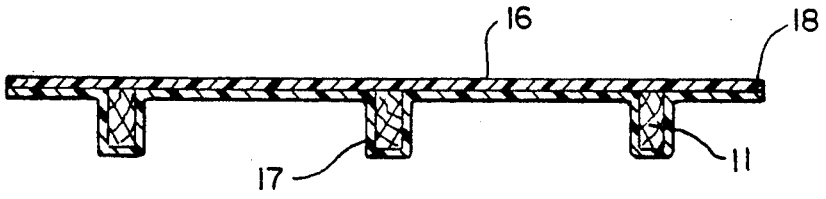
FIG. 2 is a sectional view through line 2—2 of FIG. 1.
Figure 3:
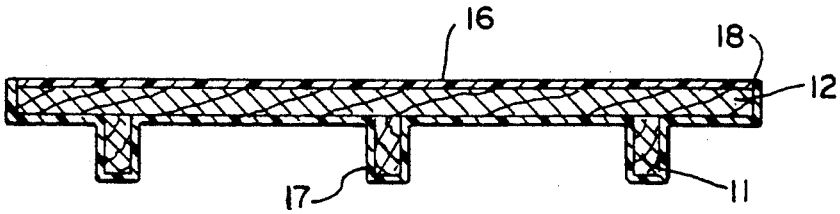
FIG. 3 is a sectional view through line 3—3 of FIG. 1.
Figure 4:
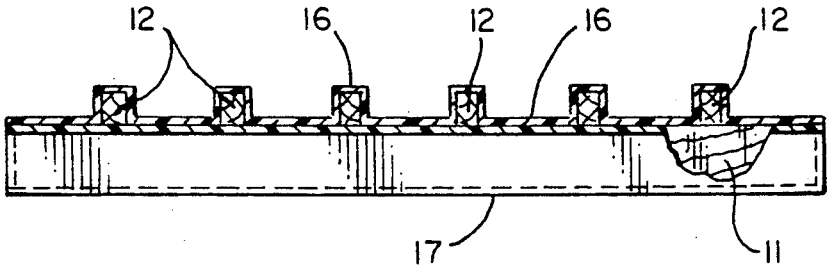
FIG. 4 is a sectional view through line 4—4 of FIG. 1.

Referring now to FIGS. 2–4, the skeleton is then inverted upon a top sheet 16 of plastic which may be of any suitable type such as ABS, polyethylene, polypropylene, nylon, or recycled plastic. The thickness of the sheet is not particularly important and can vary up to about ½ inch. The most preferred thickness is ¼ inch. The top sheet must be pre-cut to conform to the size and shape of the pallet, or preferably dual sheet molded by techniques known to the art. A bottom sheet 17, constructed of the same kinds of material as the top sheet, is pre-heated in an oven until completely pliable, and then placed over the bottom of the skeleton.

Next, using conventional thermoforming techniques of heat and suction, the bottom sheet 17 is pulled down to tightly conform to the skeleton and top sheet. Holes having diameters of about ⅛ inch to ¼ inch may be placed in appropriate locations of the top sheet 16 so as to aid the process of conforming the bottom sheet.

Once the unit has cooled to room temperature the edges of the top sheet and bottom sheet indicated at 18 are joined to form a continuous seam. This may be conveniently done by plastic welding, sonic-welding, or dual sheet self-bonding, after which the pallet is ready for use.

It can readily be appreciated that the plastic sheets can be cut away from the skeleton and the skeleton thereafter disassembled for use in replacement pallets which may be of different configuration. Furthermore, although conventional thermoforming requires a separate mold for each kind of object manufactured, according to the present invention there is no practical limit to the variety of pallet configurations which can be provided without retooling the thermoforming equipment or making special molds.

While this invention has been described with reference to the structure and method disclosed herein, it is not confined to the details set forth, and this application is intended to cover any modifications or changes as may come within the scope of the following claims.

What is claimed is:

1. A heavy duty pallet comprising a rigid, internal reinforcing skeleton, a rigid first plastic sheet, constructed of a nonheatshrinkable, nonexpanded plastic, covering the lower surface, open spaces, sides and ends of said skeleton and tightly conforming to the surfaces thereof, a rigid second plastic sheet, constructed of a nonheatshrinkable, nonexpanded plastic, covering the upper surface of said skeleton to form a flat load deck, said second plastic sheet being in contact with the edges of said first plastic sheet along the perimeter thereof and in face-to-face contact with said first plastic sheet over the open spaces of said skeleton, bonding means forming a continuous seam along the contact perimeter of said plastic sheets, said skeleton being separable from said plastic sheets when said bonding means is removed therefrom, whereby said pallet can be disassembled.

2. A heavy duty pallet, comprising a rigid, internal reinforcing skeleton, and a continuous rigid plastic skin covering said skeleton, said skin having upper and lower layers in face-to-face contact over the open spaces of said skeleton, said skin being constructed of a nonheatshrinkable, nonexpanded plastic material, and being separable from said skeleton, whereby said pallet can be disassembled when said layers are separated.

3. The pallet of claim 1 wherein said plastic sheets are constructed of a material selected from the group consisting of nylon, polypropylene, polyethylene, and recycled plastic.

4. The pallet of claim 2 wherein said plastic sheets are constructed of a material selected from the group consisting of nylon, polypropylene, polyethylene, and recycled plastic.

5. The pallet of claim 1 wherein said load deck has a non-skid surface.

6. The pallet of claim 2 wherein said load deck has a non-skid surface.

7. The pallet of claim 1 wherein said plastic sheets are about ¼ to ½ inch thick.

8. The pallet of claim 2 wherein said plastic sheets are about ¼ to ½ inch thick.

9. The pallet of claim 1 wherein said skeleton has wooden horizontal members.

10. The pallet of claim 2 wherein said skeleton has wooden horizontal members.

11. A method of fabricating a heavy duty pallet, comprising the steps of constructing a skeleton, dimensioning a first plastic sheet to the upper surface of said skeleton, placing said first plastic sheet on the upper surface of said skeleton, thermoforming a second plastic sheet over the lower surface, sides and ends of said skeleton in conforming contact therewith and in contact with said first plastic sheet along the perimeter thereof and in face to face contact with said first plastic sheet over the open spaces of said skeleton, and rigidly bonding said first plastic sheet to said second plastic sheet to form a continuous integral seam at the contact perimeter thereof.

12. The method defined in claim 11 wherein said plastic sheets are constructed of a material selected from the group consisting of nylon, polypropylene, polyethylene and recycled plastic.

13. The method defined in claim 11 wherein said skeleton is constructed of wood.

14. The method defined in claim 11 wherein said skeleton is constructed of aluminum.

15. The method defined in claim 11 wherein said first plastic sheet is rigidly bonded to said second plastic sheet by plastic welding.

16. The method defined in claim 11 wherein said first plastic sheet is rigidly bonded to said second plastic sheet by sonic welding.

17. The method defined in claim 11 wherein said first plastic sheet is rigidly bonded to said second plastic sheet by dual sheet self bonding.

18. A method of thermoforming a product, comprising the steps of constructing a skeleton, placing said skeleton on a first sheet of plastic;

preheating a second sheet of plastic until said second sheet of plastic is pliable, conforming said second sheet of plastic to the contours of said skeleton to contact said first sheet of plastic at the perimeter thereof, bonding said first sheet of plastic to said second sheet of plastic.

* * * * *

UNITED STATES PATENT AND TRADEMARK OFFICE

CERTIFICATE OF CORRECTION

PATENT NO. : 5,123,359
DATED : June 23, 1992
INVENTOR(S) : Michael W. Delbalso

It is certified that error appears in the above—identified patent and that said Letters Patent is hereby corrected as shown below:

Please delete claims 11-18.

Signed and Sealed this

Tenth Day of August, 1993

*Attest:*

Michael K. Kirk

MICHAEL K. KIRK

*Attesting Officer*

*Acting Commissioner of Patents and Trademarks*